US006001053A

United States Patent [19]

Rabe

[11] Patent Number: 6,001,053

[45] Date of Patent: Dec. 14, 1999

[54] PROCESS AND APPARATUS FOR FABRICATING A CONTAINER LID WITH AN INWARDLY FOLDED RIM

[75] Inventor: Johan O. Rabe, Buffalo Grove, Ill.

[73] Assignee: Sealright Co., Inc., DeSoto, Kans.

[21] Appl. No.: 08/935,159

[22] Filed: Sep. 22, 1997

[51] Int. Cl.[6] ..... B31B 1/88

[52] U.S. Cl. ..... 493/55; 493/84; 493/374; 493/379

[58] Field of Search ..... 493/51, 52, 53, 493/55, 64, 84, 379, 105, 374, 390

[56] References Cited

U.S. PATENT DOCUMENTS

| | | | |
|---|---|---|---|
| 3,745,891 | 7/1973 | Bodendoerfer . | |
| 4,047,473 | 9/1977 | Fletcher et al. | 493/84 |
| 4,386,576 | 6/1983 | Johnson . | |
| 4,846,774 | 7/1989 | Bell | 493/102 |
| 5,135,462 | 8/1992 | Stahlecker et al. | 493/105 |
| 5,324,249 | 6/1994 | Konzal . | |
| 5,449,337 | 9/1995 | Konzal . | |
| 5,524,817 | 6/1996 | Meier et al. . | |

*Primary Examiner*—Eugene L. Kim
*Attorney, Agent, or Firm*—Shook, Hardy & Bacon LLP

[57] ABSTRACT

The present invention discloses a method and apparatus for fabricating a novel lid for use in frozen dessert containers. The apparatus has an interchangeable mandrel for wrapping a strip to form a rim of the lid to a predetermined configuration such as a super-ellipse. The invention allows for registered offset printing of the rim of the lid. The invention also allows for use of a single material for an entire frozen dessert container. The lid manufactured from the process and apparatus may be composed of a fiberboard material with a polyethylene coating thereon. The process and apparatus allows for the cost-effective fabrication of a frozen dessert container having a non-circular cross-section.

26 Claims, 7 Drawing Sheets

Fig. 5.
(PRIOR ART)
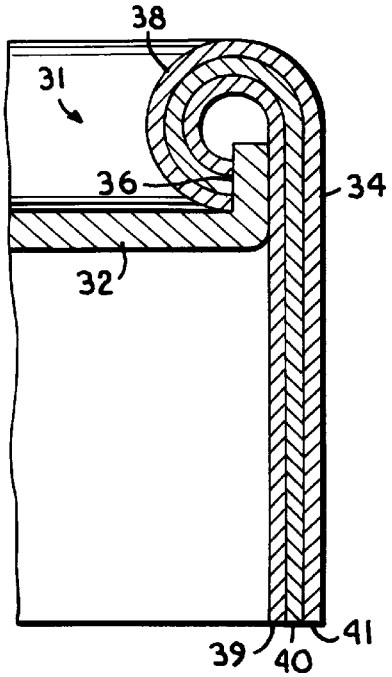
Fig. 6.
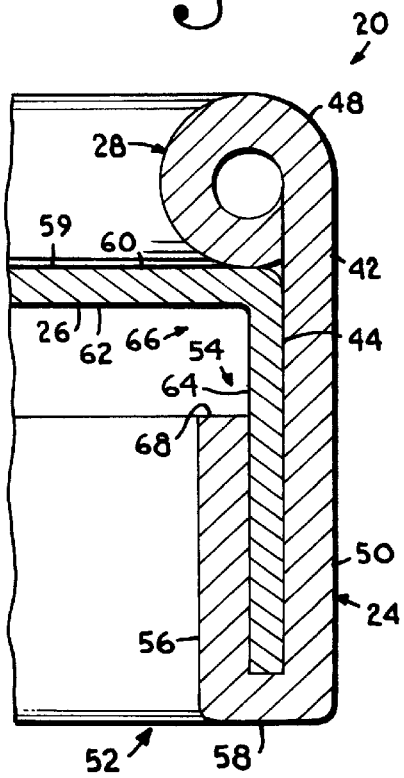
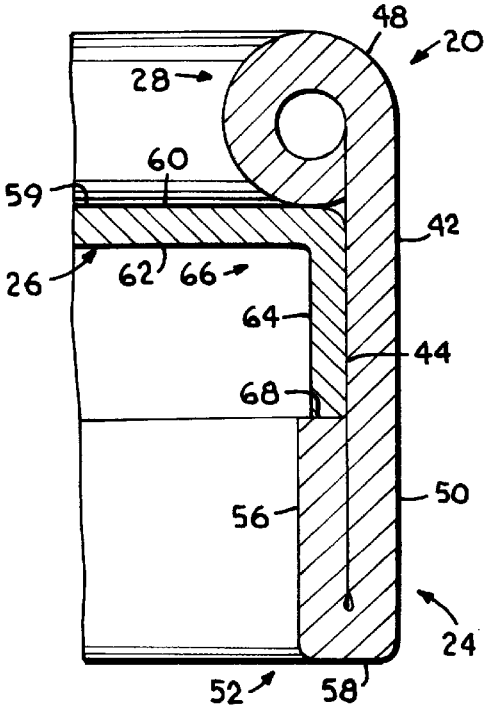
Fig. 6A.

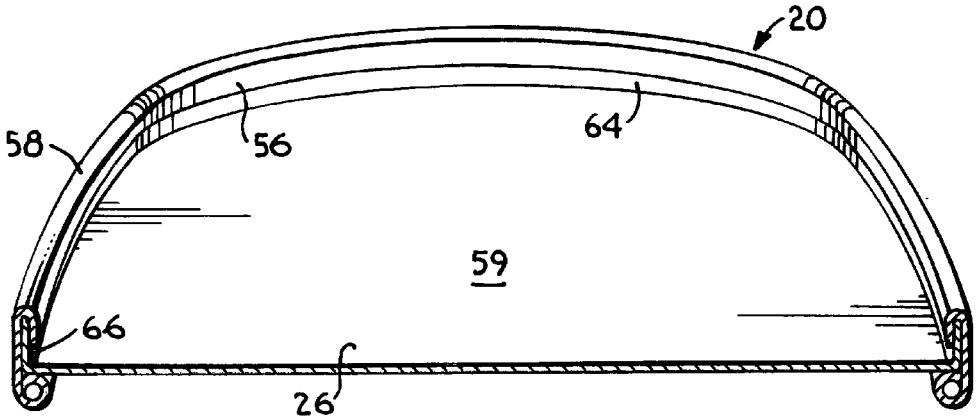
Fig. 7.
Fig. 8.
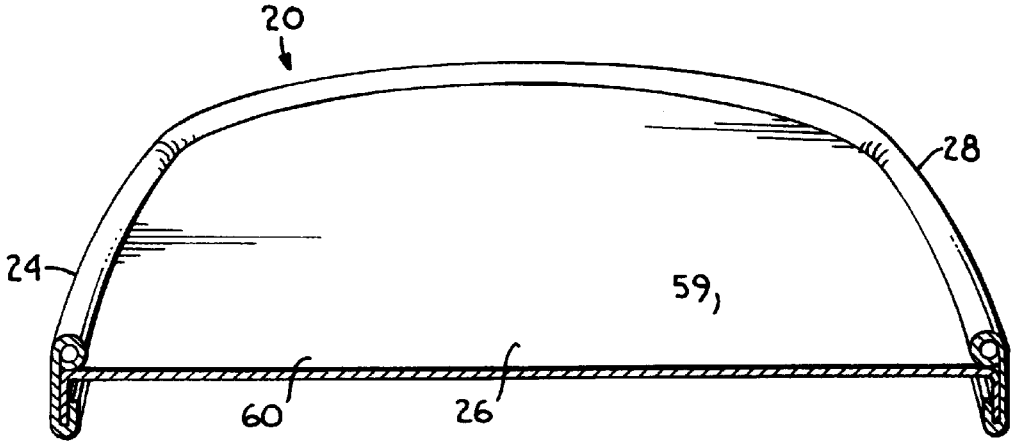

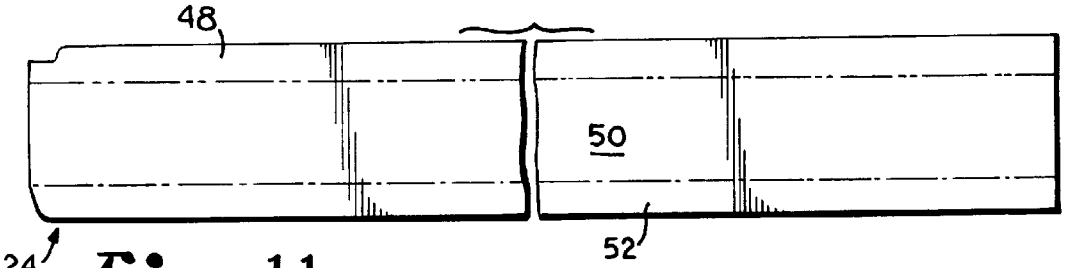
Fig. 11.
Fig. 12.
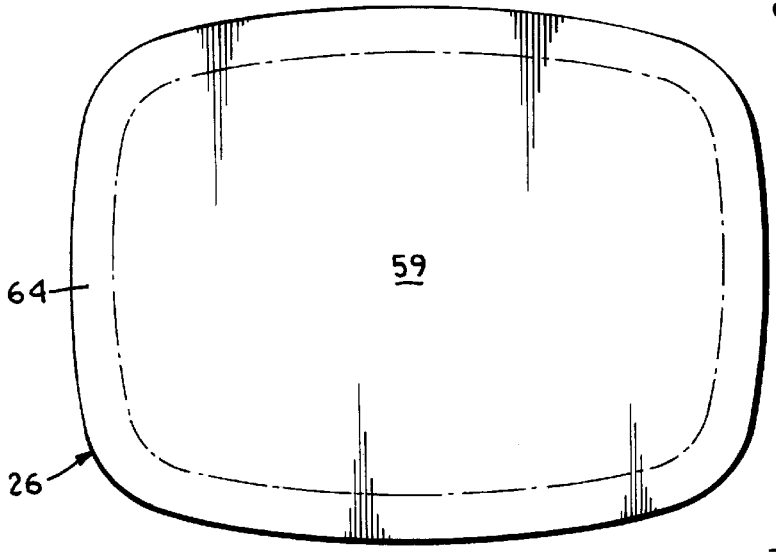
Fig. 14.
Fig. 13.
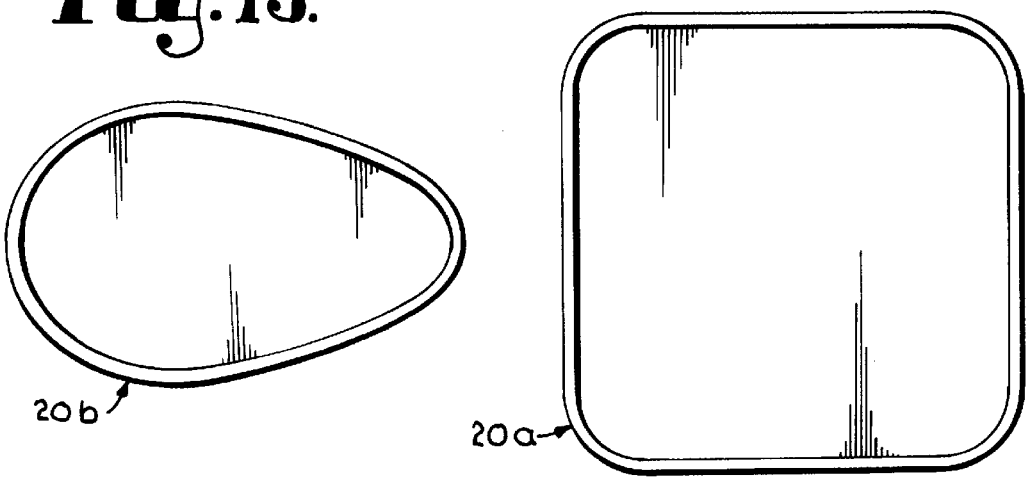

PROCESS AND APPARATUS FOR FABRICATING A CONTAINER LID WITH AN INWARDLY FOLDED RIM

BACKGROUND OF THE INVENTION

1. Field of the Invention

The present invention relates to the fabrication of a container lid. Specifically, the present invention relates to the fabrication of a container lid for utilization in conjunction with a cup to form a frozen dessert container.

2. Description of the Related Art

Packaging has progressed from being solely a containment means for a particular product, to being the primary means for marketing a product. This progression now demands that every possible space on a package be utilized for marketing. However, fabrication techniques might render such use of space for marketing either technologically or economically unfeasible.

In the packaging of ice cream, the industry has been unable to overcome this problem. Specifically, in the packaging of ice cream in cups with lids, the industry has been unable to utilize a portion of the lid for advertising, and has been for the most part locked into using a circular cup for the packaging of ice cream in cups. The reason for this limitation to a circular cup is the fact that the lid may only be manufactured in an efficient manner as a circular lid. An example of such packaging for ice cream is the TETRA CUP® ice cream container available from Tetra Pak Hoyer of Pleasant Prairie, Wis.

In a typical process, the lid is manufactured from a spiral wound tube where three strips of paper are glued and tightly wound together to form a rim portion of the lid. Then, a circular disc is "punched" into the rim portion and glued thereto. This fabrication process limits the lid to having a circular cross-section.

In order to overcome this problem in a cost effective manner, the use of plastic rims have been put forth by the industry which allows for various shapes. However, these plastic rims do not overcome the problem with the need to utilize the space for marketing, and also plastic rims are more costly than paperboard rims.

Another concern with lids is the strength and support of the lid, and more specifically the engagement between the disc and the rim. Although the circumferential flange of the disc is glued to the rim, this does not always provide adequate strength to prevent the disc from becoming disengaged from the rim during processing.

BRIEF SUMMARY OF THE INVENTION

The present invention resolves the problems of the prior art by providing a novel method and apparatus for forming a novel lid. The present invention accomplishes this through use of a mandrel having predetermined configuration on which the rim of the lid is formed.

One aspect of the present invention is a method for fabricating a lid. The first step is providing a strip of material, then wrapping the strip around a mandrel having a predetermined configuration. Next, a disc is inserted into the rim, then the rim is folded inward. The top of the rim is curled to complete the lid.

Another aspect of the present invention is an apparatus for fabricating a lid. The apparatus includes an interchangeable mandrel having a predetermined configuration. The apparatus also has a wrapping station, a folding station, an insert station and a curling station.

Another aspect of the invention is a lid fabricated from the process mentioned above.

It is a primary object of the present invention to provide a method and apparatus for fabricating a lid for a frozen dessert container.

It is an additional object of the present invention to provide a method and apparatus for fabricating a lid which may have various configurations.

It is an additional object of the present invention to provide a method and apparatus for fabricating a lid having a cross-section of a super-ellipse.

It is an additional object of the present invention to provide a method and apparatus for fabricating a lid having a non-circular cross-section.

It is an additional object of the present invention to provide a method and apparatus for fabricating a lid utilizing an interchangeable mandrel.

It is an additional object of the present invention to provide a method and apparatus for fabricating a registered offset printed lid.

It is an additional object of the present invention to provide a method and apparatus for fabricating a lid which will have the same material composition as a corresponding cup.

It is an additional object of the present invention to provide a method and apparatus for fabricating a lid having greater sealing of the rim and disc than the prior art lids.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 a flow diagram of the process of the present invention;

Figure 2:
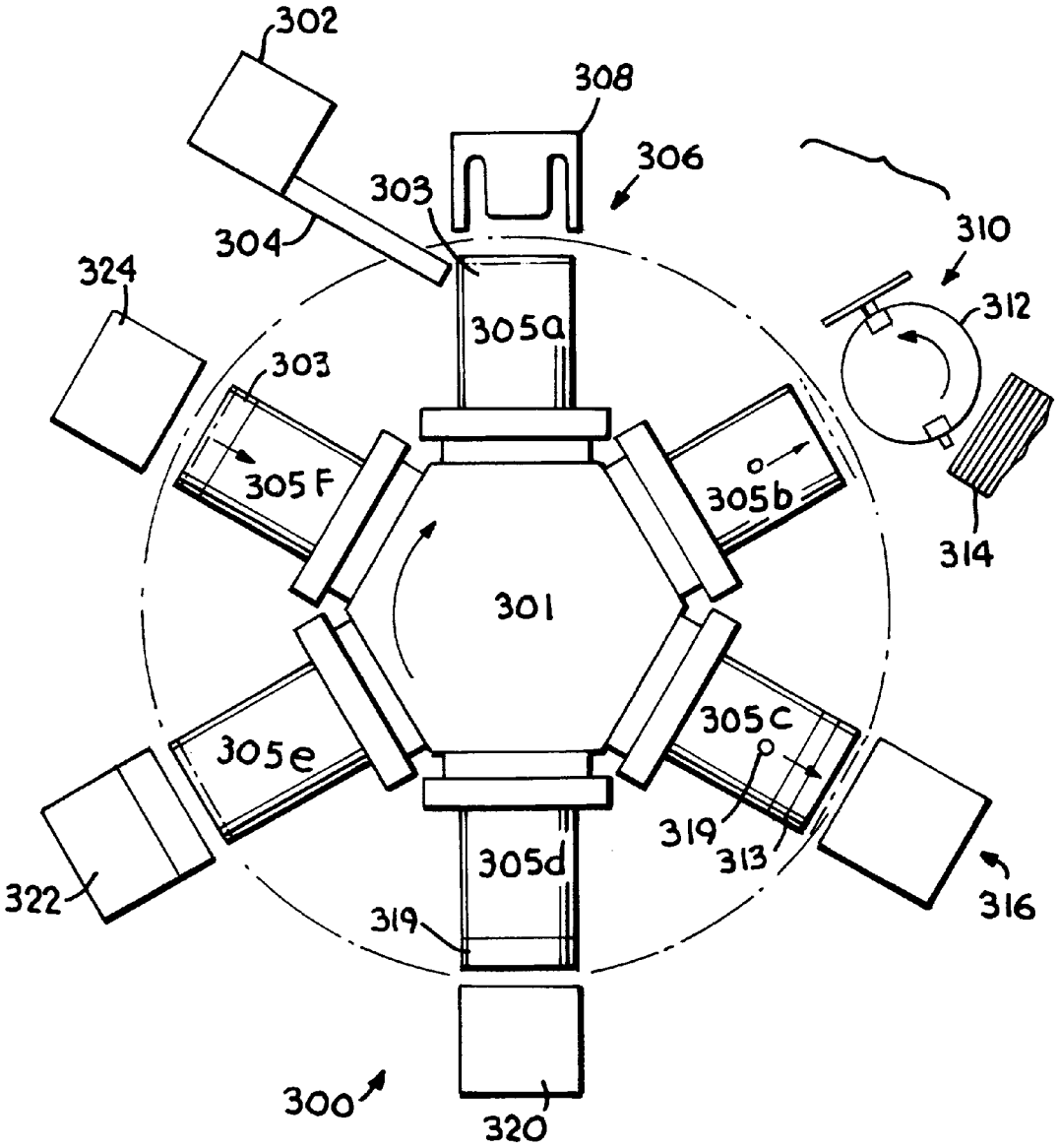
Figure 4:
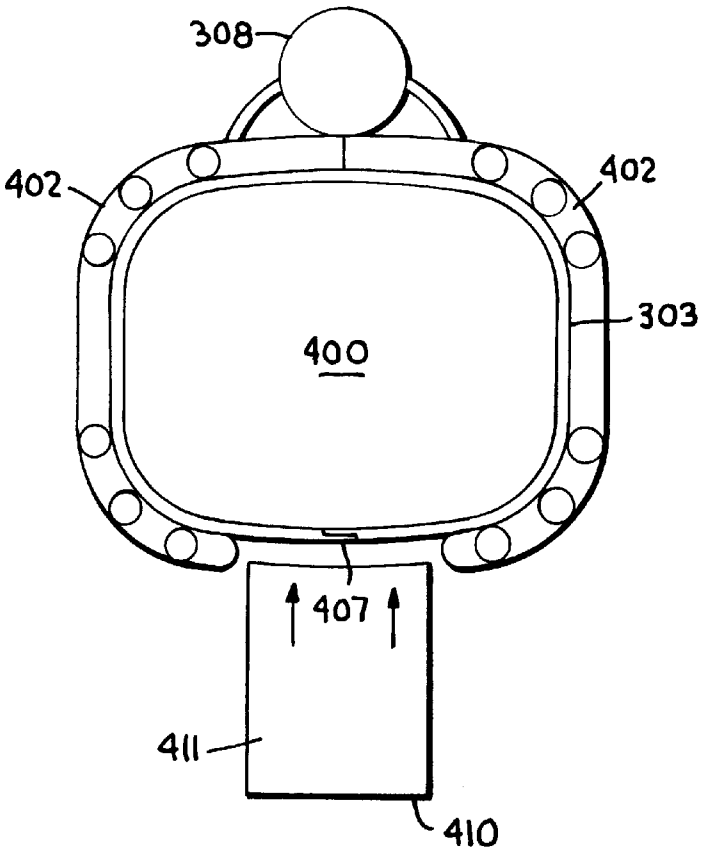
Figure 3:
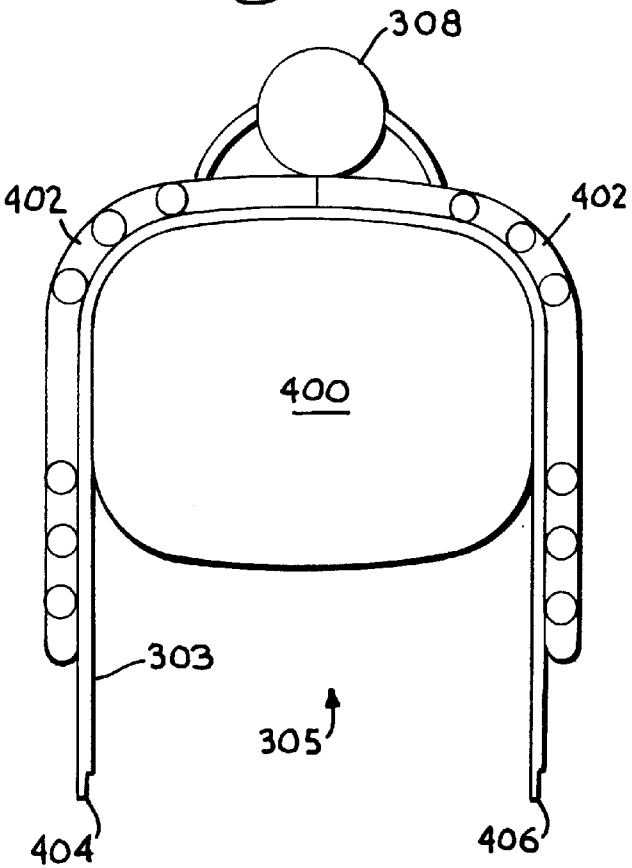
Figure 9:
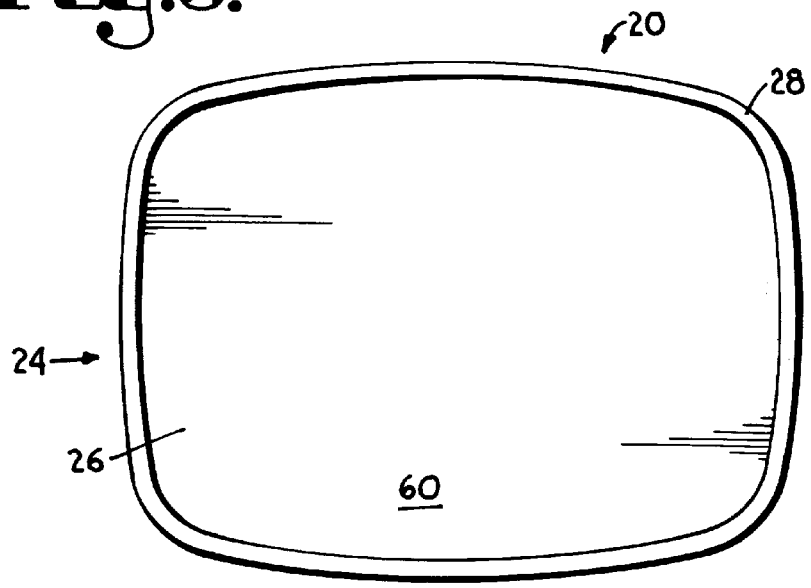
Figure 10:
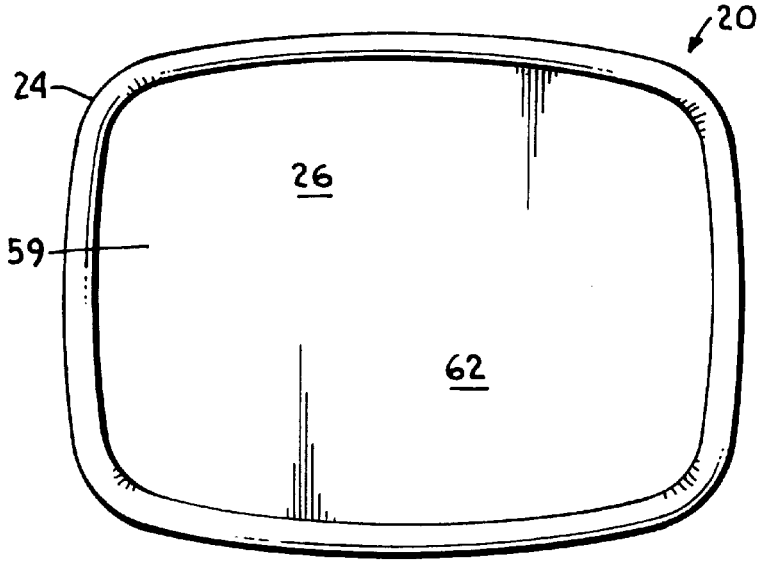

There is illustrated in FIG. 2 a schematic view of the apparatus of the present invention;

There is illustrated in FIG. 3 a schematic view of the wrapping station of the present invention at one point in time;

There is illustrated in FIG. 4 a schematic view of the wrapping station of the present invention at a second point in time;

There is illustrated in FIG. 5 a cross-sectional view of a lid of the prior art;

There is illustrated in FIG. 6 a cross-sectional view of the lid of the present invention;

There is illustrated in FIG. 6A a cross-sectional view of an alternative lid of the present invention;

There is illustrated in FIG. 7 a perspective cut-away view of the bottom of a lid of the present invention;

There is illustrated in FIG. 8 a perspective cut-away view of the top of a lid of the present invention;

There is illustrated in FIG. 9 a top plan view of the preferred embodiment of the lid of the present invention;

There is illustrated in FIG. 10 a bottom plan view of the preferred embodiment of the lid of the present invention;

There is illustrated in FIG. 11 a plan view of a pre-formed rim of the lid of the present invention;

There is illustrated in FIG. 12 a plan view of a pre-formed disc of the lid of the present invention;

There is illustrated in FIG. 13 a top plan view of an alternative embodiment of the present invention;

There is illustrated in FIG. 14 top plan view of another alternative embodiment of the present invention.

DETAILED DESCRIPTION OF THE INVENTION

The novel lid of the present invention is to be utilized in conjunction with an open-top cup such as utilized in the packaging of ice cream. However those skilled in the pertinent art will recognize other applications of the lid of the present invention that are within the scope and spirit of the present invention. An open-top cup as defined herein has a continuous wall, an enclosed bottom and a top that has at least a portion open which necessitates the utilization of a lid, even if a membrane such as a plastic or aluminum foil is used to cover the open top for added protection from the environment.

A lid is placed upon on cup to complete a container for the packaging of a desired product such as ice cream, sorbet, frozen yogurt, and the like. The cup may have various configurations such as super-elliptical, elliptical, oval, pseudo-rectangular, circular, and the like. The lid will have a corresponding configuration in order to effectively cover the cup.

The lid may be composed of a fiberboard material having a polyethylene coating thereon. The use of a fiberboard material allows for the cost efficient printing of text or artwork on the rim of the lid. It also allows for use of an entire container composed of a single material, polyethylene coated fiberboard. From an environmental perspective, the use of a "mono-material" provides for facilitated recycling of the material since the step of separating different material from each other is avoided.

Figure 1:
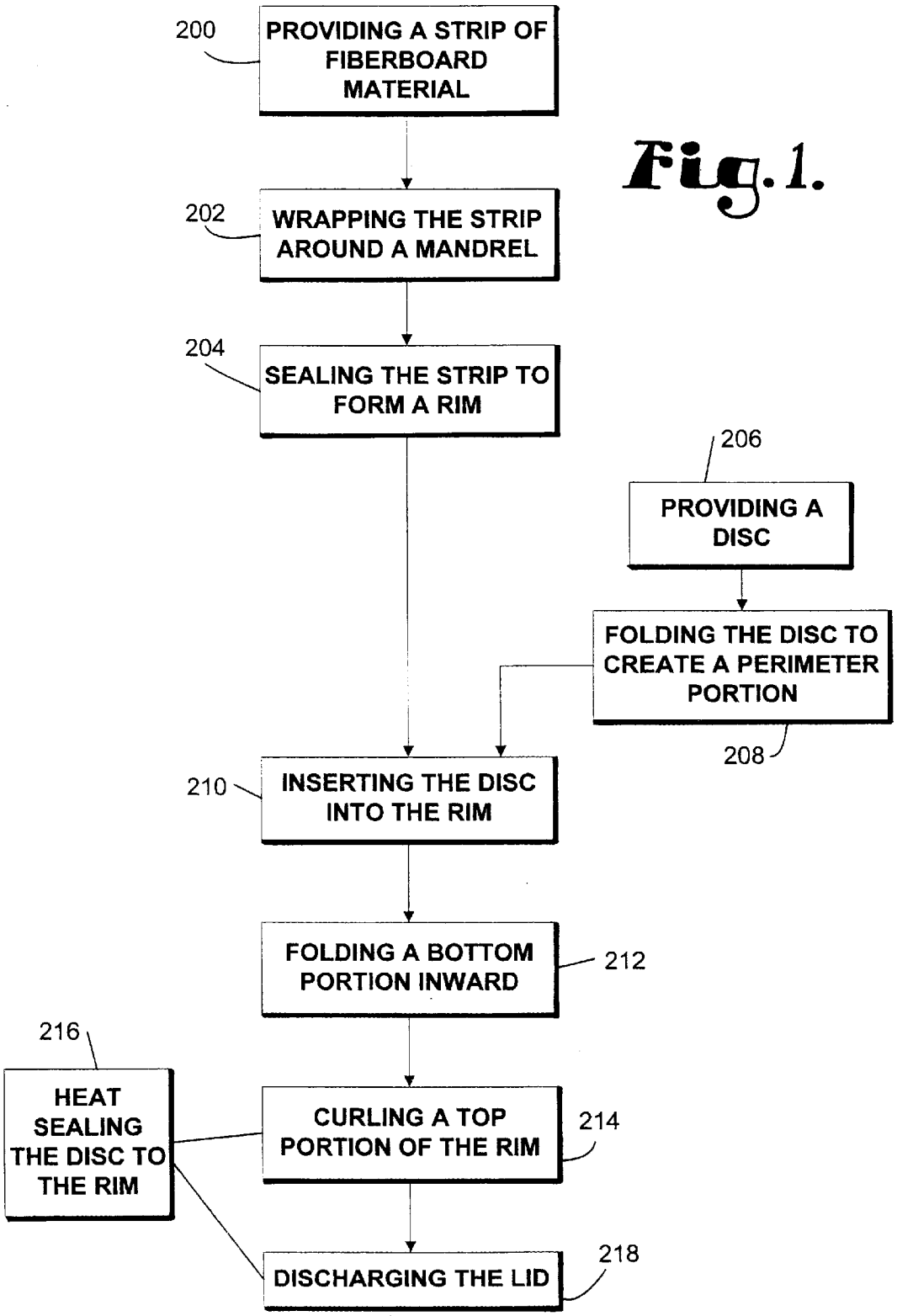

FIG. 1 shows a flow diagram of the process of the present invention. At step 200, a strip composed of a fiberboard material is provided. The fiberboard material may be coated with polyethylene. At step 202, the strip is wrapped around a mandrel. The mandrel has a predetermined configuration which determines the cross-section/shape of the lid. At step 204, the strip is sealed onto itself to form a continuous rim of a predetermined cross-section/shape. A preferred cross-section is a super-ellipse, however, other cross-sections are well within the scope of the present invention. At step 206, a disc is provided, the disc composed of the same material as the rim. At step 208, the disc is folded to create a perimeter portion as described below. The perimeter portion is substantially perpendicular to the entirety (the flat portion) of the disc. At step 210, the disc is inserted into the rim with the perimeter portion of the disc inserted to abut the central portion of the rim. At step 212, a bottom portion of the rim is folded inward to encompass the perimeter portion of the disc. At step 214, a top portion of the rim is curled inward to form an edging thereby geometrically securing the disc to the rim. At optional step 216, the disc is heat sealed to the rim to create a chemical bond securing the disc to the rim. At step 218, the lid is discharged for future use with a cup to form a container for frozen desserts.

FIG. 2 shows a schematic view of the apparatus of the present invention. The apparatus is generally designated 300 and it includes various stations positioned around a rotating turret 301. However, those skilled in the pertinent art will recognize that other apparatus are well within the scope of the present invention. A strip supply 302 supplies strips 303 to a strip feeder 304. The strip feeder transports the strips 303, one at a time, to a mandrel 305 at a wrapping station 306. At the wrapping station 306, the strip is wrapped around the mandrel 305 by a wrapping device 308 which will be described below. In this apparatus 300, the strip 303 is sealed to itself through heat sealing at the wrapping station 306 thereby creating a rim 303*a*. However, other embodiments might have the sealing completed at another station or at a stand-alone station which are both within the scope of the present invention. Additionally, the strip 303 has an adhesive thereon thereby effecting sealing upon wrapping of the strip 303 onto itself. The turret 301 then rotates at a predetermined interval to position the mandrel 305 with the rim 303*a* wrapped thereon to the insert station 310. At the insert station 310, a disc feeder 312 supplies disc 313 from a disc supply 314. The disc feeder 312 folds the perimeter portion of the disc rendering the perimeter portion substantially perpendicular to the flat portion of the disc 313. At the insert station 310, the folded disc 313 is inserted into the rim 303*a*.

At the folding station 316, a bottom portion of the rim 303*a* is folded inward onto the perimeter portion. Before moving to the next station, the curling station 320, the mandrel 305 should reduce its "diameter" about the top portion of the rim 303*a*. To accomplish this, the mandrel may have an adjustable portion 319 which contracts when the mandrel 305 approaches the curling station thereby permitting the inward curling of the top portion of the rim 303*a*.

The turret 301 then rotates to transport the mandrel with the disc and rim complex thereon to a curling station 320 where the top portion of the rim 303*a* is curled inward to form an edging as described below. The turret then rotates to position the mandrel 305 at an optional heat sealing station 322 where the disc is heat sealed to the rim 303*a* for added strength. This may be accomplished by heated air blown onto the disc and rim complex. The mandrel is then rotated to a discharge station 324 where the lid is discharged for future use with a cup as described herein.

Detailed mechanisms useful for folding, inserting and curling are known by those skilled in the pertinent art although such mechanisms have not been used for purposes of the present invention. Such mechanisms exists in cup and carton manufacturing.

FIGS. 3 and 4 illustrate the operation at the wrapping station 306. The projecting end 400 of the mandrel 305 has the strip 303 wrapped around it by a wrapping device 308. The wrapping device 308 has a pair of jointed wings 402 which engage the strip 303 and fold it around the mandrel 305 thereby forming the rim 303*a* into the shape of the mandrel 305. End 404 is placed on top of end 406 of the strip to have a desirable mating 407. As shown in FIG. 4, a heater 410 blows heated air, shown by arrows 411, onto the rim 303*a* for sealing.

In a preferred embodiment, the mandrel 305, and thus the rim, have a super-ellipse cross-section/shape. However other cross-sections/shapes are well within the present invention including but not limited to oval, circular, elliptical and the like. The mandrel 305 is removable from the turret 301, or whatever other mechanism may be used for maneuvering the mandrel 305 from station to station. The removable/detachable mandrel 305 allows for a multitude of configurations to be formed on the same apparatus by minor adjustments. For example, if an oval shape is desired, the mandrel 305 is substituted for a mandrel having a oval cross-section/shape. The wrapping device is adjusted to wrap around an oval shape, folding is adjusted and the curling is adjusted. However, the mandrel is the only new piece of equipment utilized on the apparatus when changing lid configurations.

FIG. 5 illustrates the prior art lid 31 which has a disc 32 and a rim 34. The disc has an upwardly folded portion 36 abutting the rim 34. The rim 34 has a curled top 38 engaging the folded portion 36. The disc 32 is glued to the rim 34 which provides the only attachment mechanism for this lid 31. Also, the boundary of the lid 31 as defined by the rim 34 only consists of one layer except for the very top where the folded portion 36 provides a second layer. Thus, to provide greater strength and support to the lid, the rim would have to be composed of a thicker paper during the fabrication process. Also shown in FIG. 5 is the first, second and third strips 39–41 which are glued together on the spiral winder to form the rim 34 of the prior art. The exterior layer 41 is often of a desire color to match the rest of the artwork that might be printed on the packaging for marketing purposes. However, printed text and artwork cannot cost efficiently be printed on this exterior layer 41.

FIG. 6 illustrates the preferred embodiment of the lid 20 of the present invention. A rim 24 has an exterior surface 42, facing away from a disc 26, and an interior surface 44 facing toward the disc 26. Both surfaces 42 and 44 may be coated with polyethylene, polyester, or the like. Alternatively, only one of the surfaces 42 and 44 may be coated with polyethylene, polyester, or the like. The rim may be divided into a top portion 48, a central portion 50 and a bottom portion 52. The bottom portion 52 is folded inwardly about the inserted disc to create an annular recess 54 wherein the perimeter portion rests. Defining the inward folding of the bottom portion 52 more specifically, the bottom portion 52 is folded substantially perpendicular to the central portion 50, then folded upward to create a parallel branch 56 of the bottom portion 52 and a perpendicular branch 58 of the bottom portion 52. The annular recess 54 is defined by the parallel branch 56 on one side, the perpendicular branch 58 on the bottom, and the central portion 50 on the side opposite the parallel branch 56.

The top portion 48 is curled inward to form the edging 28 of the lid. This curling usually will occur subsequent to the insertion of the disc 26. The disc 26 has a main body 59 with an upper surface 60 and a lower 62. Both surfaces 60 and 62 may be coated with polyethylene, polyester, or the like. Alternatively, only one of the surfaces 60 and 62 may be coated with polyethylene, polyester, or the like. The disc 26 also has a perimeter portion 64 which is folded substantially perpendicular to the upper and lower surfaces 60 and 62, and inserted into the annular recess 54. The perimeter portion 64 may be formed, and then the parallel branch 56 and perpendicular branch 58 formed around the perimeter portion 64. Those skilled in the art will recognize that folding of the disc 26 and the rim 24 at various angles other than ninety degrees to create a similar engagement between the disc 26 and rim 24 is well within the scope and spirit of the present invention.

The perimeter portion 64 may be heat sealed to the interior surface 44 of the contacted portions of the rim 24 which may include the central portion 50, the parallel branch 56 and the perpendicular branch 58. The curled edging 28 abuts the upper surface 60, and may be heat sealed thereto for added strength and support. Thus, not only is the disc 26 engaged with the rim 24 mechanically, it is also engaged with the rim gravitationally and if necessary, chemically. The mechanical engagement is the compression pressure engagement between the perimeter portion 64 and the walls of the annular recess 54. The gravitational engagement is created by the perpendicular branch 58 and the edging 28 which depending on how the lid is placed (normally or upside down), act as support to receive the downward force of the disc created by gravity. The chemical engagement is created by the heat sealing of the polyethylene (or other polymer coating) surfaces to one another creating chemical bonds between the surfaces. This provides greater attachment between the disc 26 and the rim 24, then the attachment of the prior art.

Still referring to FIG. 6, another benefit of the lid 20 of the present invention is the added strength and support created by the triple layer wall composed of the central portion 50, the perimeter portion 64 and the parallel branch 56. Comparing FIG. 5 and FIG. 6, the triple layer wall of the lid 20 is almost three times as thick as the single layer wall of the lid 31 of the prior art. The three strips 39, 40 and 41 of the prior art lid 31 represent thinner paperboard material in order to achieve structure of the lid 31. If the paperboard thickness of rim 24 was used for each of the layer 39, 40 and 41, then adjustments would need to be made to the curled portion 38 and the cup of the prior art because the thicker rim 34 would fit differently. Also, the entire engagement of the disc 32 with the rim 34 at the folded portion 36 would be compromised due to thicker paper. Whereas the lid 20 of the present invention may use various paperboard thickness since the engagement of the disc 26 and the rim 24 would not be compromised. The ability to vary the thickness of the wall of the lid greatly increases the application of the lid of the present invention. Also, the ability to have a triple layer thickness from essentially a single layer allows for greater savings in material, and less waste.

Again referring to FIG. 6, an annular channel 66 is defined by a projecting end 68 of the bottom portion 52, a part of the perimeter portion 64, and a part of the lower surface 62 of the disc 26. The annular channel 66 may engage with the top of a cup, not shown, for added sealability of the cup and the lid thereby creating not only an interference fit, but also a gravitational and geometric fit. This tremendously enhanced sealability prevents leaking of the product which might occur. during filling wherein the cup is filled with a viscous "frozen" dessert product, the lid is placed thereon, and the container is inverted for freezing the product.

FIG. 6A illustrates a variation on the folding of the bottom portion 52 as stated above in reference to FIG. 2. In this variation, the parallel portion 56 is mated with the central portion 50 thereby creating a shoulder at the projecting end 68 for the perimeter portion to rests upon. Also, the annular recess 54 is removed from this variation.

To accomplish this, the apparatus described in FIG. 2 would have to be modified in the following manner. First the positioning of the insert station 310 and the folding station 316 would be reversed to allow for the folding of the rim 303*a* prior to insertion of the disc 313. At the folding station 316, the bottom portion of the rim 303*a* would be folded onto itself to allow for positioning of the disc onto the shoulder. Next, subsequent to folding, the rim would have to be reoriented to allow for insertion of the disc 313. Several means may be utilized to accomplish this reorientation. First, the rim 303*a* may be moved to the opposite end of the mandrel, then the mandrel 305 rotated 180 degrees about an axis 311 through the center of the mandrel 305. Thus, the mandrel 305 must be removable from the turret 301 which it is to effect changes in the size of the mandrel cross section/shape as discussed below. Alternatively, the rim 303*a* may be pulled off the mandrel 305, rotated 180 degrees and reattached to the mandrel with the top of the rim 303*a* projecting out from the mandrel 305 and the folded bottom portion nearest the center of the turret 301.

FIGS. 7 and 10 illustrate the bottom of the lid 20. The parallel branch 56 continually engages with the perimeter portion 64 of the disc 26. The annular channel 66 also continues about the perimeter of the body 59 of the disc 26. FIGS. 8 and 9 illustrate the top of the lid 20. The edging 28 of the rim 24 continually engages with upper surface 60 of the main body 59 of the disc 26.

FIG. 11 illustrates a strip 303 of the present invention prior to being folded to make the rim 24. The central portion 50 is bounded by top portion 48 and bottom portion 52. The top portion 48 and the bottom portion 52 may have various dimensions depending on the needs of the lid. FIG. 12 illustrates a pre-formed disc 26 with the main body 59 bounded by perimeter portion 64. The perimeter portion 64 may have various dimensions depending on the needs of the lid 20. The configuration of the body 59 will also be the major factor in determining the configuration of the lid 20. The body should have a configuration substantially similar to that of the cup 22 for which the lid 20 is intended for as a cover.

As stated above, a preferred configuration is a super-ellipse which is the joining of two ellipses. Other possible configurations are set forth in FIGS. 13 and 14 which would necessitate a mandrel having a similar configuration as those of the lids in FIGS. 13 and 14. The possibilities include circular and non-circular configurations. The prior art is limited to circular configurations due to the fabrication process used in the prior art.

The lid 20 of the present invention allows for greater printing on the rim 24 of the lid, for example as shown in FIG. 11, "Tetra Pak Hoyer®", which was unavailable for the prior art. Particularly, registered offset printing using a sheet fed printer which allows for accurate registration and no overlapping of the print as is common with the prior art technology of spiral wound lids. The printing may take place at the same facility where the printing of the side of the cup is performed thereby providing for greater savings.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A process for fabricating a container lid, the process comprising:

providing a strip of a predetermined length having first and second ends;

providing a mandrel having a predetermined shape;

wrapping the strip around the mandrel;

sealing the strip to itself at its ends thereby forming a rim having an interior and an exterior surface, the interior surface of the rim defining an interior perimeter, the rim further having a top portion and a bottom portion;

providing a disc having a shape conforming to the interior perimeter of the rim, the disc having a central portion and a perimeter portion, the perimeter portion being substantially perpendicular to the central portion;

inserting the disc into the rim;

folding a predetermined amount of the bottom portion of the rim inward to define a folded section, wherein at least a portion of the interior surface of the rim in the folded section faces another portion of the interior portion of the rim; and curling a predetermined amount of the top portion of the rim.

2. The process according to claim 1 wherein the strip is composed of a fiberboard material.

3. The process according to claim 1 wherein the mandrel has a non-circular cross-section.

4. The process according to claim 1 wherein the perimeter portion of the disk has an inwardly facing surface and an outwardly facing surface and wherein at least a portion of the inner surface of the rim in the folded section abuts a portion of the inwardly facing surface of the disk and at least another portion of the inner surface of the rim abuts a portion of the outwardly facing surface of the disk to substantially encompass the perimeter portion of the disc.

5. The process according to claim 1 wherein the top portion of the rim is curled inwardly until a portion of the top portion abuts the disc.

6. The process according to claim 1 further comprising heat sealing the disc to the rim subsequent to inserting the disc into the rim.

7. The process according to claim 1 wherein the mandrel has a super-ellipse cross-section.

8. The process according to claim 1 comprising the further step of printing indicia on the strip prior to the strip being wrapped around the mandrel.

9. The process according to claim 4 comprising the further steps of heat sealing the perimeter section of the disc to the interior surface of the rim prior to folding a predetermined amount of the bottom portion of the rim inward and heat sealing the folded section of the rim to the perimeter section of the disc.

10. An apparatus for fabricating a container lid, the container lid having a disc and a rim encompassing the disc, the apparatus comprising:

a strip feeder for supplying a plurality of strips;

a disc feeder for supplying a plurality of discs having a central portion and a perimeter portion, the perimeter portion being substantially perpendicular to the central portion of said disc;

a mandrel having a predetermined cross-section, the mandrel disposed on a turret for transferring the mandrel to a multiple of stations, the mandrel receiving a strip from the strip feeder at a first station;

a wrapping station for wrapping the strip about the mandrel thereby forming a rim having a top and bottom portion, the wrapping station disposed subsequent to the first station;

an insert station for receiving a disc from the disc feeder and inserting the disc into the rim;

a folding station for folding a bottom portion of the rim inward until the folded portion of the rim is substantially parallel to a portion of the rim remaining unfolded; and a curling station for curling the top portion of the rim inward to form an edging.

11. The apparatus according to claim 10 further comprising a heat sealing station for heat sealing the disc to the rim, the heat sealing station disposed subsequent to the curling station.

12. The apparatus according to claim 10 wherein the mandrel has a non-circular cross-section.

13. The apparatus according to claim 10 wherein the rim is folded to encompass a perimeter portion of the disc at the folding station.

14. The process according to claim 10 wherein the inserting a disc into the rim at the insert station comprises inserting a perimeter portion of the disc against a inwardly folded portion of the rim, the perimeter portion substantially perpendicular to the entirety of the disc.

15. The apparatus according to claim 10 wherein the mandrel has a super-ellipse cross-section.

16. The apparatus according to claim 10 wherein the mandrel is interchangeable.

17. The apparatus according to claim 10 further comprising a sealing station for sealing the strip together to form a rim, the sealing station disposed prior to the insert station.

18. The apparatus according to claim 10 wherein the strip is a single layer of fiberboard material.

19. The apparatus according to claim 10 wherein the turret has a plurality of mandrels disposed an equal distance from each other allowing for a mandrel to be disposed at every station of the apparatus at any single time interval.

20. The apparatus of claim 10, wherein the disc has a central section and a perimeter section, said perimeter section being substantially perpendicular to said central section and wherein the folding station is for folding a portion of the rim around the perimeter section of the disc.

21. The apparatus of claim 10, wherein the curling station forms the edging in contact with the disc to thereby secure the disc in place.

22. A lid for utilization with an open-top cup, the lid fabricated according to the process comprising:

providing a strip of a predetermined length having first and second ends;

wrapping the strip around a mandrel, the mandrel having a predetermined shape thereby forming a seam wherein the strip overlaps itself at its ends;

sealing the strip to itself thereby forming a rim having an interior and an exterior surface and a top and bottom portion;

inserting a disc into the rim, the disc having a shape conforming to the interior perimeter of the rim and having a perimeter portion substantially perpendicular to the entirety of the disc;

folding a predetermined bottom portion of the rim inwardly until the folded portion of said rim is substantially parallel to a portion of the rim remaining unfolded to substantially encompass the perimeter portion of said disc; and curling the top portion of the rim.

23. A method of making a lid for a container comprising:

providing a strip of a predetermined length having first and second ends;

providing a mandrel having a predetermined shape;

wrapping the strip about the mandrel wherein the ends of the strip meet in an overlapping relationship;

securing the ends of the strip to each other thereby forming a rim, the rim having an interior surface, an exterior surface, a top portion, a central portion, and a bottom portion, the interior surface defining an opening;

folding the bottom portion of the rim inward until at least a portion of the inner surface of the rim in the bottom portion abuts a portion of the inner surface of the rim in the central portion;

providing a disc having a shape conforming to the opening, the disc further having a central portion and a perimeter portion, the perimeter portion being substantially perpendicular to the central portion of the disc and having a bottom edge;

inserting the disc into the opening of the rim until the bottom edge of the perimeter portion abuts a top edge of the bottom portion of the rim; and curling the top portion of the rim inward until a portion thereof abuts the disc.

24. The method of claim 23, wherein the bottom portion of the rim is parallel to the central portion of the rim.

25. The method of claim 23, comprising the further step of heat sealing the bottom portion of the rim to the central portion of the rim prior to providing the disc.

26. The method of claim 25, comprising the further step of heat sealing the perimeter portion of the disc to the central portion of the rim.

* * * * *